US009121243B1

(12) United States Patent
Headifen

(10) Patent No.: US 9,121,243 B1
(45) Date of Patent: Sep. 1, 2015

(54) MULTIFUNCTION WELL PLUG DUAL LOCKING ELEMENTS

(71) Applicant: Ross Headifen, Thibodaux, LA (US)

(72) Inventor: Ross Headifen, Thibodaux, LA (US)

( * ) Notice: Subject to any disclaimer, the term of this patent is extended or adjusted under 35 U.S.C. 154(b) by 324 days.

(21) Appl. No.: 13/670,098

(22) Filed: Nov. 6, 2012

(51) Int. Cl.
*E21B 33/03* (2006.01)
*E21B 33/02* (2006.01)

(52) U.S. Cl.
CPC *E21B 33/02* (2013.01); *E21B 33/03* (2013.01)

(58) Field of Classification Search
CPC ..... E21B 33/00; E21B 33/02; E21B 33/03
USPC ..... 411/373; 70/177; 292/251
See application file for complete search history.

(56) References Cited

U.S. PATENT DOCUMENTS

| | | | | |
|---|---|---|---|---|
| 875,689 | A | 1/1908 | Bowser | |
| 2,133,465 | A * | 10/1938 | Purtell | 411/373 |
| 2,218,581 | A | 10/1940 | Levan | |
| 2,245,887 | A | 6/1941 | Wikander | |
| 3,477,607 | A | 11/1969 | Fuzzell | |
| 3,618,811 | A | 11/1971 | Martino | |
| 3,950,971 | A | 4/1976 | Karls | |
| 4,073,168 | A | 2/1978 | Takada | |
| 4,411,312 | A | 10/1983 | English | |
| 4,881,597 | A | 11/1989 | Hensley | |
| 5,035,265 | A | 7/1991 | Chen | |
| 5,307,841 | A | 5/1994 | Condon | |
| 5,437,309 | A | 8/1995 | Timmons | |
| 5,664,626 | A | 9/1997 | Watts, III | |
| 6,419,104 | B1 | 7/2002 | Sarajian | |
| 6,883,546 | B1 | 4/2005 | Kobylinski | |
| 8,074,334 | B2 | 12/2011 | Tharp et al. | |

FOREIGN PATENT DOCUMENTS

| | | |
|---|---|---|
| CN | 2844227 | 9/2005 |
| CN | 201155314 | 2/2008 |
| CN | 201358473 | 2/2009 |
| KR | 20120021589 | 3/2012 |

* cited by examiner

*Primary Examiner* — Robert E Fuller
*Assistant Examiner* — Steven MacDonald
(74) *Attorney, Agent, or Firm* — Michael I. Kroll

(57) ABSTRACT

A well plug having an elastomeric seal ring between a top and a bottom cap with a shaft disposed in the throughbore. Rotation of the shaft compresses the ring between the caps forming a hermetic seal with the well pipe walls. The shaft contains an axial bore with a transverse aperture proximate its base to allow for sampling and/or instrumentation to be introduced into the pipe. An O-ring seal between the shaft and the top cap receptacle forms a seal preventing the bore contents leaking out or the ambient environment leaking in. The plug has two rotational locks to prevent unauthorized removal. One is a platform with an aperture extending from the upper portion of the shaft receiving a threaded fastener preventing rotation through radially extending vertical top cap structures. The other is a cantilevered platform, with an aperture for a padlock preventing rotation by the shafts side wing members.

12 Claims, 9 Drawing Sheets

MULTIFUNCTION WELL PLUG DUAL LOCKING ELEMENTS

BACKGROUND OF THE INVENTION

1. Field of the Invention

The present invention relates generally to well plugs and, more specifically, to a multifunction well plug comprising a top cap, shaft, elastomeric seal ring and bottom cap.

The top cap and bottom cap matingly engage the elastomeric seal ring with the shaft seated within a top cap receptacle and then extending through the elastomeric seal ring to threadingly engage the bottom cap so that when the multifunction well plug is placed inside of a pipe and the shaft rotated, typically by the provided shaft wings, the bottom cap axially moves up the shaft compressing the elastomeric seal ring causing it to circumferentially extend until frictionally engaging the interior pipe wall thereby forming a watertight seal.

To prevent tampering with the seated well cap, the top cap provides an integral cantilevered platform having an aperture for placement of a lock, such as a padlock. The shackle of the padlock protruding above the top-cap platform forms a shaft-wing rotation abutment limiting rotation to no more than half a turn.

Furthermore, the shaft provides an integral cantilevered platform having a threaded aperture for placement of a tamperproof fastener comprising a threaded fastener having a hemispherical head with a centrally disposed cavity forming a socket for an internal drive that can only be driven by a correspondingly shaped driver. The hemispherical head eliminates any vertical surfaces that a pair of pliers or similar tool can grip to remove the tamperproof fastener.

2. Description of the Prior Art

There are other well plugs designed for pipe bores While these well plugs may be suitable for the purposes for which they where designed, they would not be as suitable for the purposes of the present invention as heretofore described. It is thus desirable to provide a multi-function well plug having a pair of apertured cantilevered platforms with one having a smooth bore accommodating the shackle of a padlock and the other having a threaded bore accommodating a tamperproof threaded fastener thereby providing a locking system that can employ either or both locking methods.

It is further desirable to provide a threaded fastener having a hemispherical head with a shaped cavity so that the fastener can only be removed through a driver having a correspondingly shaped contour.

SUMMARY OF THE PRESENT INVENTION

A primary object of the present invention is to provide a multi-function well plug comprising a top cap, shaft, elastomeric seal ring and bottom cap.

Another object of the present invention is to provide a multi-function well plug wherein said top cap has a top side and a bottom side with the top side having a cavity with the cavity forming support for the shaft.

Yet another object of the present invention is to provide a multi-function well plug wherein said top-cap top side has a cantilevered horizontally extending platform with an aperture extending through the platform serving as receptacle for a locking member, such as the shackle of a padlock.

Still yet another object of the present invention is to provide a multi-function well plug wherein said top-cap top side has multiple radially extending ribs forming blocking elements/lock stops to prevent rotation of the shaft when a locking member is employed.

An additional object of the present invention is to provide a multi-function well plug wherein said top-cap bottom side has a raised lip forming a locating seat for the flanged top end of the elastomeric seal ring.

A further object of the present invention is to provide a multi-function well plug wherein said top-cap has a raised step subjacent to its apertured horizontal platform so that when a padlock is used as the locking member a shackle portion is supported on said raised step.

A yet further object of the present invention is to provide a multi-function well plug wherein said elastomeric seal ring comprises a top side annular flange mateable to the bottom lip of the top cap to locate the elastomeric ring and hold it in place.

A still yet further object of the present invention is to provide a multi-function well plug wherein said bottom cap has a top side and a bottom side with a threaded bore extending therebetween for matingly engaging the shaft threads so that rotation of the shaft will compress the elastomeric seal ring axially causing it to protrude outwardly engaging the interior wall of the well pipe.

Another object of the present invention is to provide a multi-function well plug wherein said shaft has a top portion and a bottom portion with the top portion having a pair of spaced apart wings to aid in manual rotation of the shaft without the use of tools.

Yet another aspect of the present invention is to provide a multi-function well plug having a flange on the shaft below the wings whose diameter exceeds the diameter of the cavity in the top side of the top cap, which avoids any falling water, such as in rain, from running down inside the top cap potentially leaking inside the well.

Still yet another object of the present invention is to provide a multi-function well plug wherein said shaft has a horizontally extending cantilevered platform with a threaded aperture extending through the platform serving as receptacle for a threaded locking member.

Yet another object of the present invention is to provide a multi-function well plug wherein each of said wings has opposing side depressions to aid in gripping the wings during manual rotation of the shaft.

A further object of the present invention is to provide a multi-function well plug wherein said shaft bottom end further provide at least one horizontal transverse aperture for attachment of a connector that can be used to attach well bore instrumentation.

An additional object of the present invention is to provide a multi-function well plug wherein said shaft can have a centrally disposed cavity extending from the shaft horizontal aperture up through the top of the shaft.

A yet further object of the present invention is to provide a multi-function well plug incorporating a pair of selective locking means consisting of the top-cap platform aperture receiving the shank of a pad lock so that when placed therein the shaft rotation is limited to a half turn before further rotation is prevented by the shaft wings encountering the padlock shackle. The second locking means consists of a shaft platform threaded aperture receiving the threaded fastener that when placed therein limits the shaft rotation to approximately a sixth turn before engaging the top-cap's top side vertical ribs.

A still yet further object of the present invention is to provide an additional element for the well plug by providing a shaft having a through bore with the top end aperture optionally providing for the use of threads where valves and/or instrumentation can be fixedly attached for sampling/measuring well characteristics without removing the well cap.

A still yet further object of the present invention is to provide an annular seal around the shaft to the top cap. This seal prevents any gas leakage out of the bore along the thread path and allows the user to then monitor bore gas pressure.

A still yet further object of the present invention for when using a vented cap for down hole instrumentation use, the vented fitting on top of the cap has a push in connection to simply allow flexible tubing to be inserted and the other end of the tubing raised up and out of any possible surface water collection to prevent said water from draining back through the vent and down into the well.

Another object of the present invention is to provide an O-ring seal between the shaft and the top cap top receptacle that forms a gas and water tight seal to prevent the bore contents leaking out or the ambient environment leaking in.

Additional objects of the present invention will appear as the description proceeds.

The present invention overcomes the shortcomings of the prior art by providing a multifunction well plug comprising a top cap, shaft, elastomeric seal ring and bottom cap, where the shaft has an upper end with wings converging into a partially threaded shaft that is seated within the top cap receptacle and extends through the base of the top cap, elastomeric seal ring then threadingly engages the bottom-cap threads wherein rotation of the wings and thus the shaft causes the elastomeric ring to compress and expand outwardly until engaging the well shaft wall creating a hermetic seal of the well shaft.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
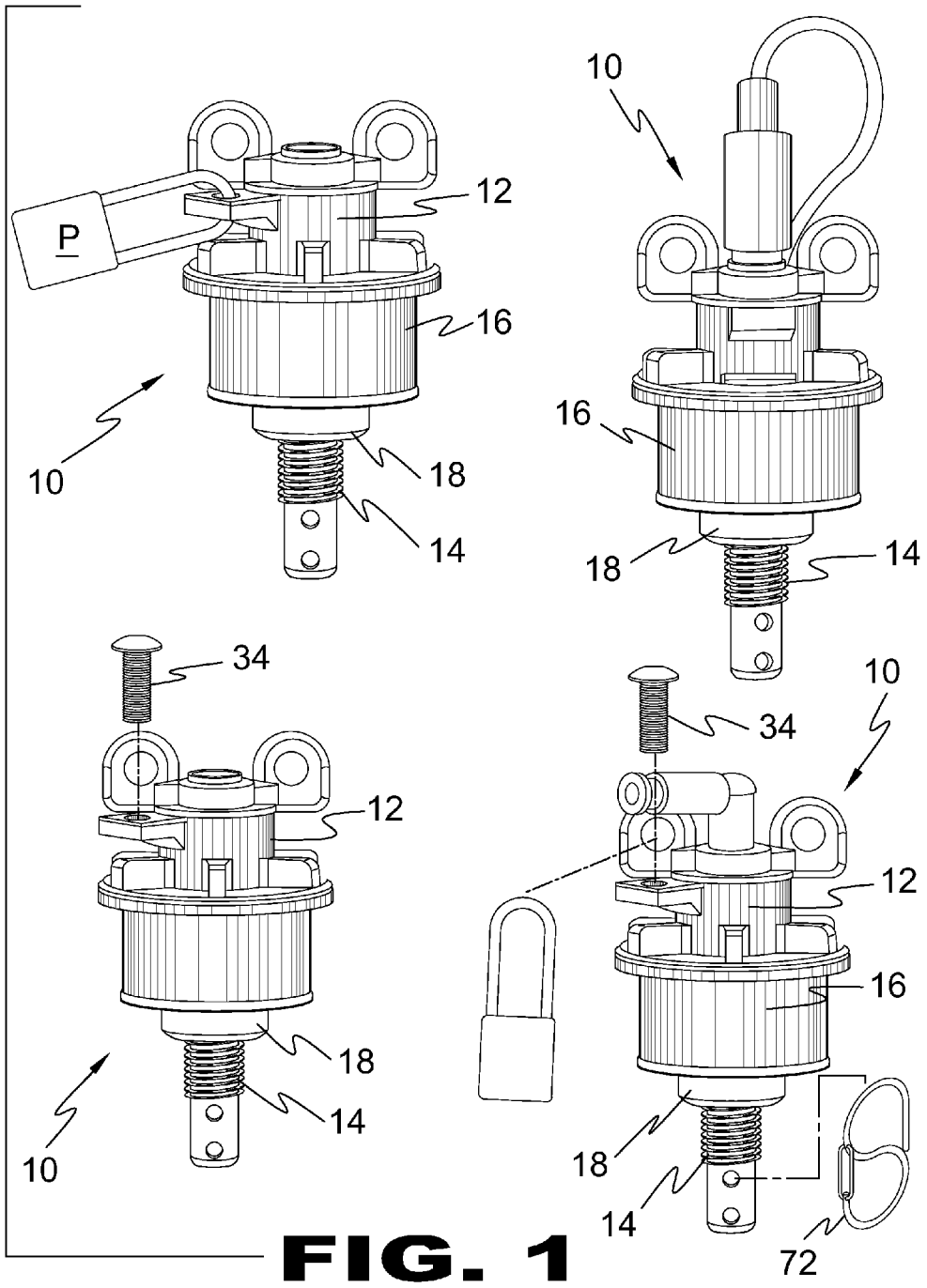
FIG. 1 illustrates perspective views of the multi-function well plug of the present invention with versions incorporating additional elements.

Turning now descriptively to the drawings, in which similar reference characters denote similar elements throughout the several views, the Figures illustrate the Multifunction Well Plug Dual Locking Elements of the present invention. With regard to the reference numerals used, the following numbering is used throughout the various drawing figures.

10 well plug
12 top cap
14 shaft
16 elastomeric seal ring
18 bottom cap
20 shaft bore
22 shaft threaded engagement portion
24 shaft top end
26 side wing
28 side wing
30 shaft top end integral cantilevered platform
32 shaft cantilevered platform threaded aperture
34 tamperproof fastener
36 tamperproof fastener rounded head
38 top cap integral cantilevered platform
40 top cap platform aperture
42 shaft base transverse apertures
44 shaft base end
46 shaft O-ring placement position
47 O-ring
48 top cap top side
50 top cap bottom side
52 top cap top side receptacle
54 top cap bottom side downwardly depending annular flange
56 elastomeric seal ring flanged top end
58 bottom cap top side
60 bottom cap bottom side
62 bottom cap threaded bore
64 bottom cap top side annular ridge
66 top cap radially positioned vertical structures
68 tamperproof fastener shaft
70 additional valves, sensors, or instrumentation
72 clip or other attachment means
100 well plug throughbore
S shackle
P padlock

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

Referring to FIG. 1, shown are various views of the multi-function well plug of the present invention that also provides for additional elements. The multi-function well plug 10 comprised of a top cap 12, shaft 14, elastomeric seal ring 16, and bottom cap 18 is designed to be inserted into a well bore wherethen the well plug shaft 14 is rotated causing the well plug bottom cap 18 to rotatively advance up shaft 14 which circumferentially extends the elastomeric seal ring 16 until it frictionally engages the interior pipe wall thereby forming a watertight seal. The present invention further provides a shaft 14 having a through bore 20 (as seen in FIG. 4) that may incorporate threads whereby valves and instrumentation can be attached to said shaft throughbore to measure well characteristics.

Figure 2:
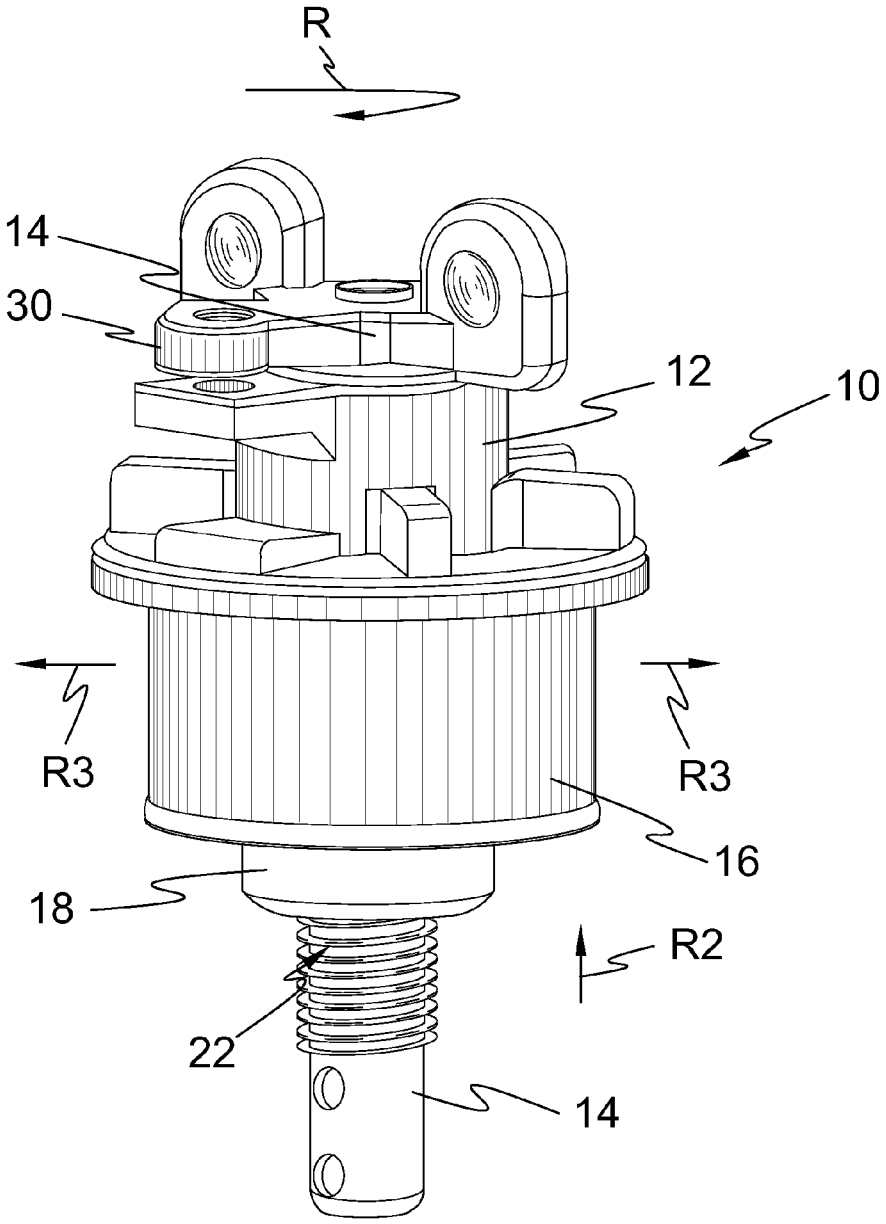
FIG. 2 is a front perspective view of the multi-function well plug of the present invention.

Referring to FIG. 2, shown is a front perspective view of the present invention. The multi-function well plug 10 is comprised of a top cap 12, shaft 14, elastomeric seal ring 16, and bottom cap 18. The top cap 12 and bottom cap 18 matingly engage opposing ends of the elastomeric seal ring 16, while the shaft 14 matingly engages the top cap 12 and threadingly engages the bottom cap 18 as indicated at 22 so that rotation of the shaft as seen in arrow R causes the bottom cap to advance up the shaft, as indicated in arrow R2 compressing the elastomeric seal ring 16, which will expand as indicated in arrows R3 until frictionally engaging the interior wall of the well shaft.

Figure 3:
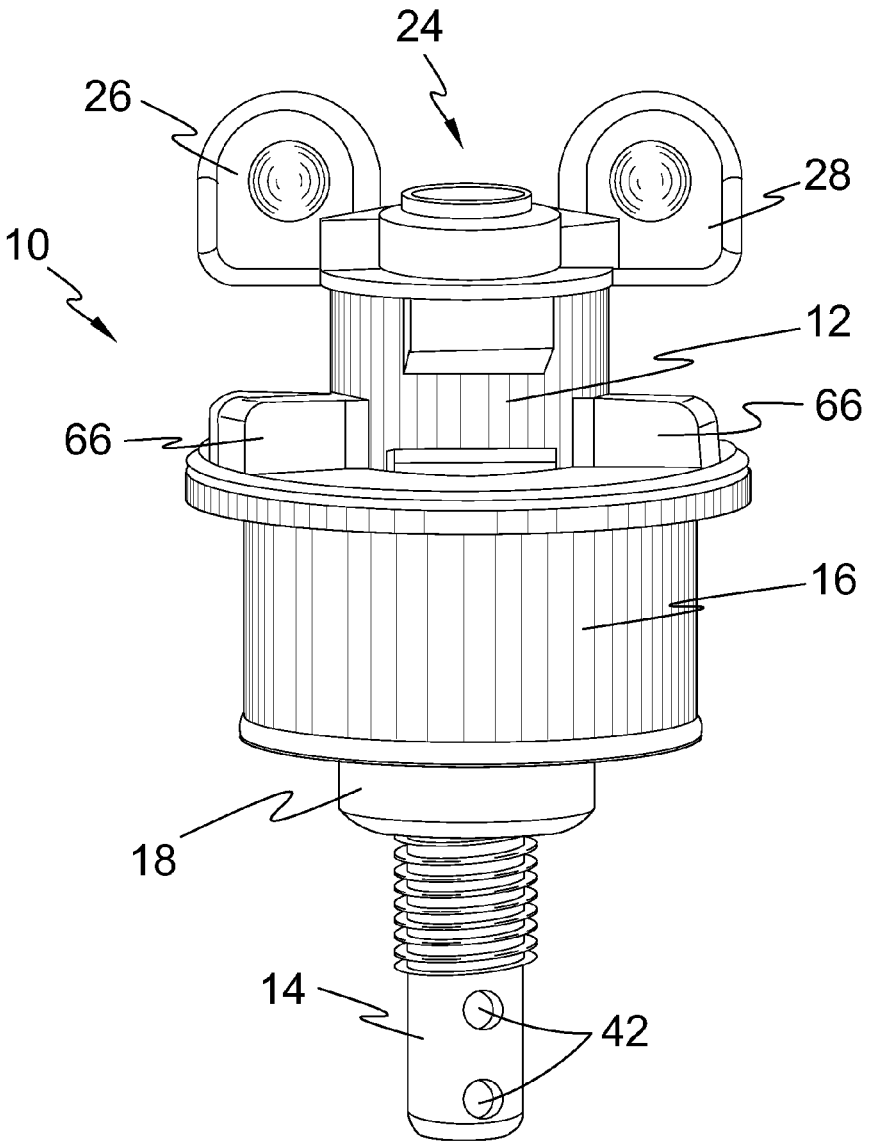
FIG. 3 is a front view of the multi-function well plug of the present invention.
Figure 7:
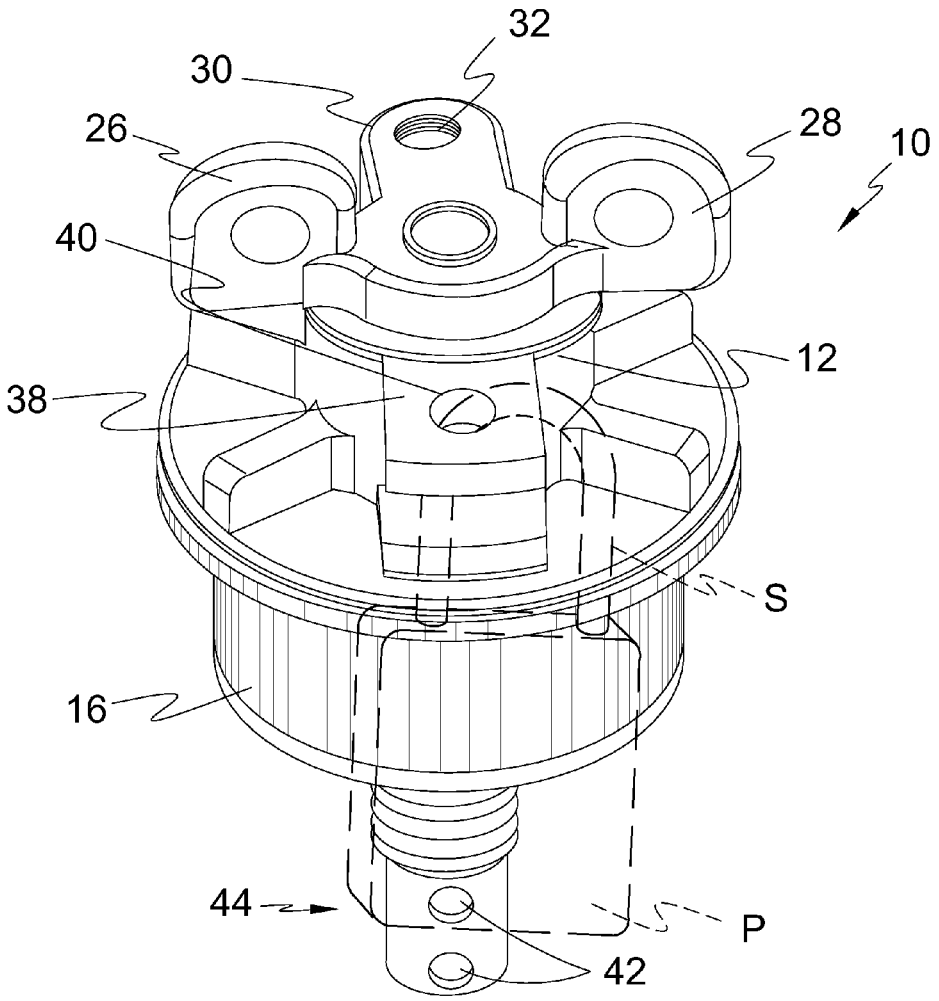
FIG. 7 is a top perspective view of the multi-function well plug of the present invention using a padlock.

Referring to FIG. 3, shown is a front view of the present invention. The multi-function well plug 10 of the present invention provides a shaft 14 having a top end 24 with opposing side wings 26, 28 having an integral cantilevered platform 30 with a threaded aperture 32 (seen in FIG. 8) forming a seat for a tamperproof fastener 34 having a rounded head 36 (both also shown in FIG. 8), the head 36 having a profiled cavity, such as a torx bolt, that requires a similarly shaped driver to fasten and remove. A second locking method, illustrated in FIG. 7, is provided by the top cap 12 having a top cap integral cantilevered platform 38 (here seen disposed on the opposite side of the shaft 14 from the shaft side wing cantilevered platform 30) which has a smooth aperture 40 for receiving the shackle S of a padlock P so that when the padlock is installed the wings 26, 28 of the shaft 14 will engage the shackle S preventing further rotation. Also shown is the shaft 14 having at least one transverse aperture indicated at 42 located approximate the shaft base 44 whereby one or more fasteners can be used to attach instrumentation.

Figure 4:
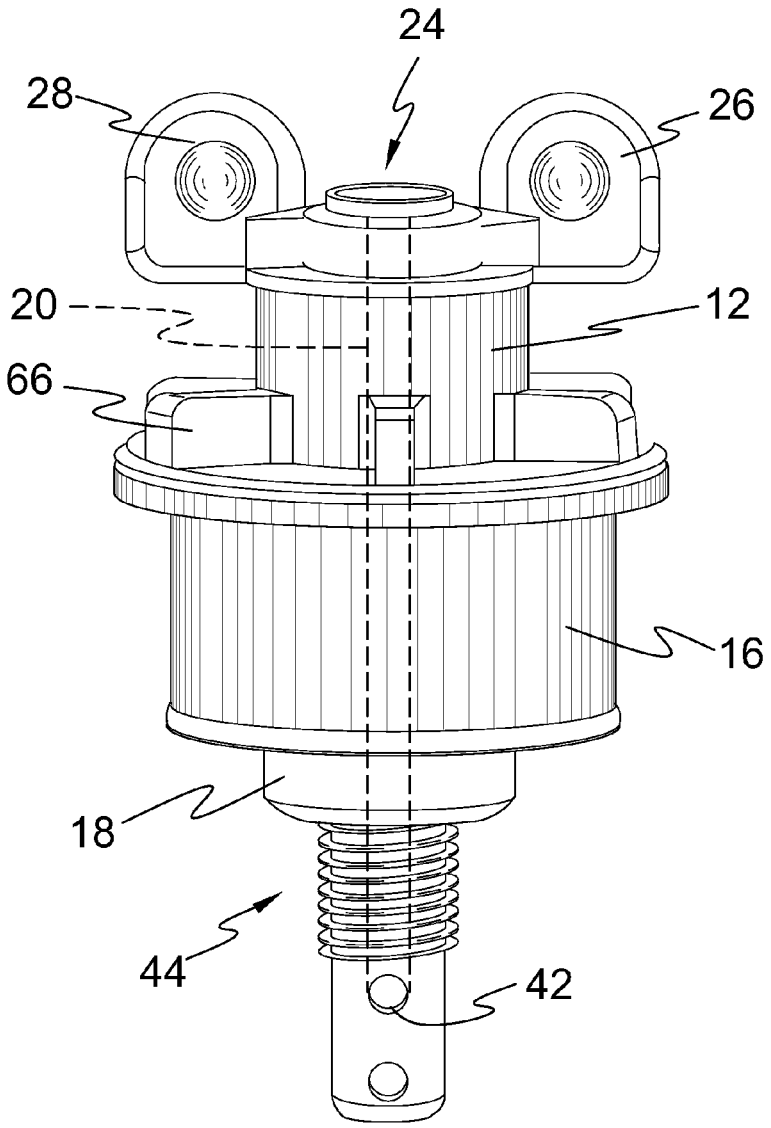
FIG. 4 is a rear view of the multi-function well plug of the present invention with the throughbore indicated.

Referring to FIG. 4, shown is a back view of the well plug incorporating an additional element. Depicted is a back view of the well plug 10 of the present invention wherein the shaft cavity extends through the shaft top end 24 providing a through bore 20 extending the length of the well plug 10 down to the shaft upper transverse hole indicated at 42. The present invention envisions a valve or instrument conjoined to the through bore, either threadedly, adhesively or other means known within the art whereby conditions within the well shaft can be measured and monitored without removal of the well plug 10.

Figure 5:
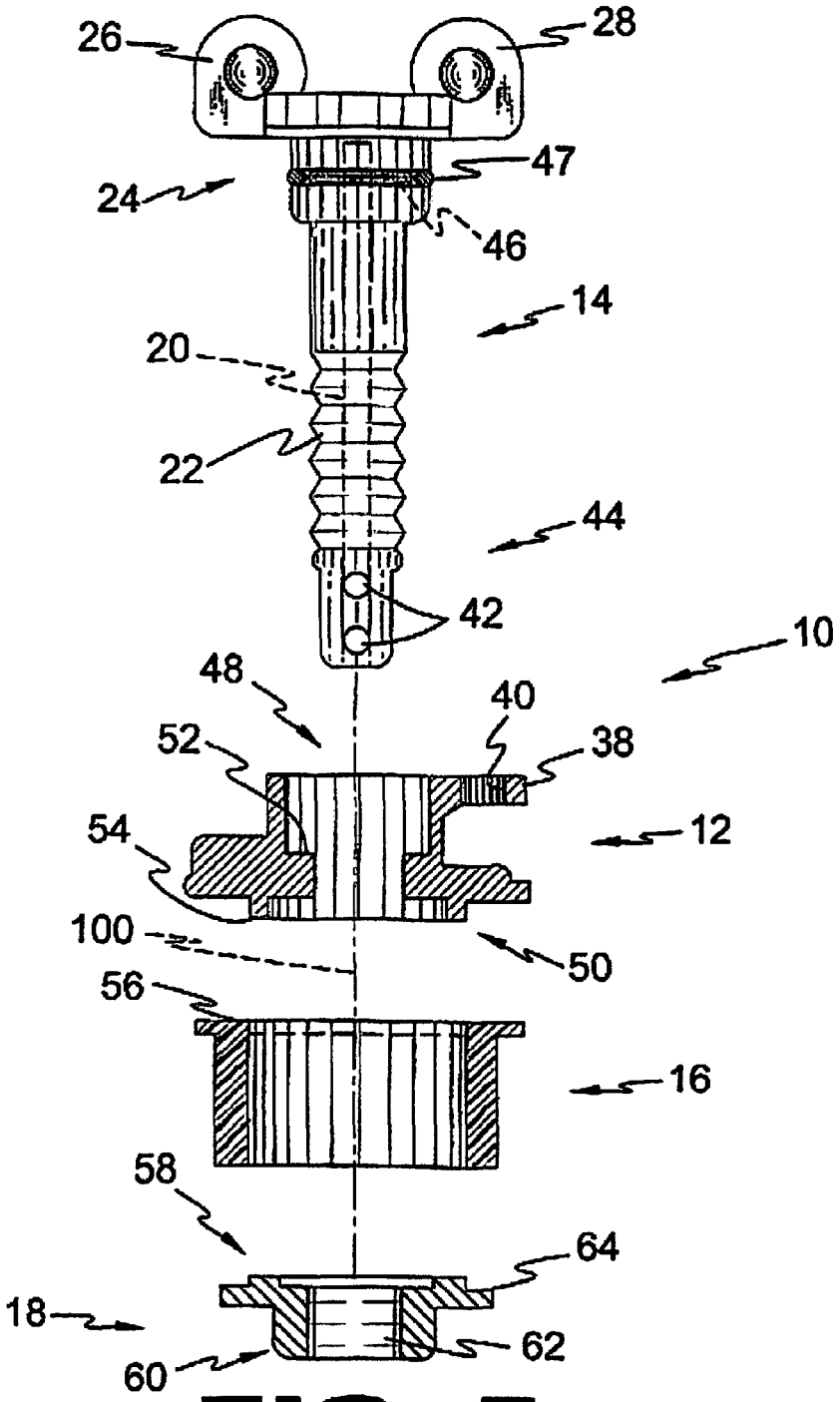
FIG. 5 is an exploded partial sectional view of the multi-function well plug of the present invention.

Referring to FIG. 5, shown is an exploded sectional view of the well plug of the present invention. Illustrated is the well plug 10 comprising a shaft 14, top cap 12, elastomeric seal ring 16, and bottom cap 18. The central sections of top cap 12, elastomeric seal ring 16 and bottom cap 18 describe a well plug throughbore 100. The shaft has a top end 24 with opposing side wings 26, 28 to aid in manual rotation of the shaft. Further provided on the shaft is an integral cantilevered platform 30 (seen in other Figs.) with a threaded aperture 32 for threadedly inserting a tamperproof fastener 34. Also shown is the shaft having a longitudinal cavity or bore 20 extending approximately from the top of the shaft 24 down to intersection with the top transverse hole 42. The shaft has at least one transverse aperture (all indicated at 42) for attachment of instrumentation by clips, hangers or fasteners. The shaft has an O-ring placement position 46 for the implementation of an O-ring 47 seal between the shaft 14 and the top cap 12 to prevent the leakage of gas pressure along the threaded path.

The top cap 12 has a top side 48 and a bottom side 50 with the top side having a receptacle 52 forming support for the shaft. Also shown is the top cap's cantilevered platform 38 having an aperture 40 extending through the platform serving as receptacle for a locking member, such as a padlock shackle.

Further illustrated is the top-cap bottom side 50 having a downwardly depending annular flange 54 spaced interiorly from the bottom-side rim forming a seat for the flanged top end 56 of the elastomeric seal ring 16. The bottom cap 18 has a top side 58 and a bottom side 60 with a threaded bore 62 extending therebetween for threadedly engaging the shaft threads 22. Also shown is the top side 58 of the bottom cap 18 having an annular ridge 64 dimensioned to fit within the base of the elastomeric ring 16.

Figure 6:
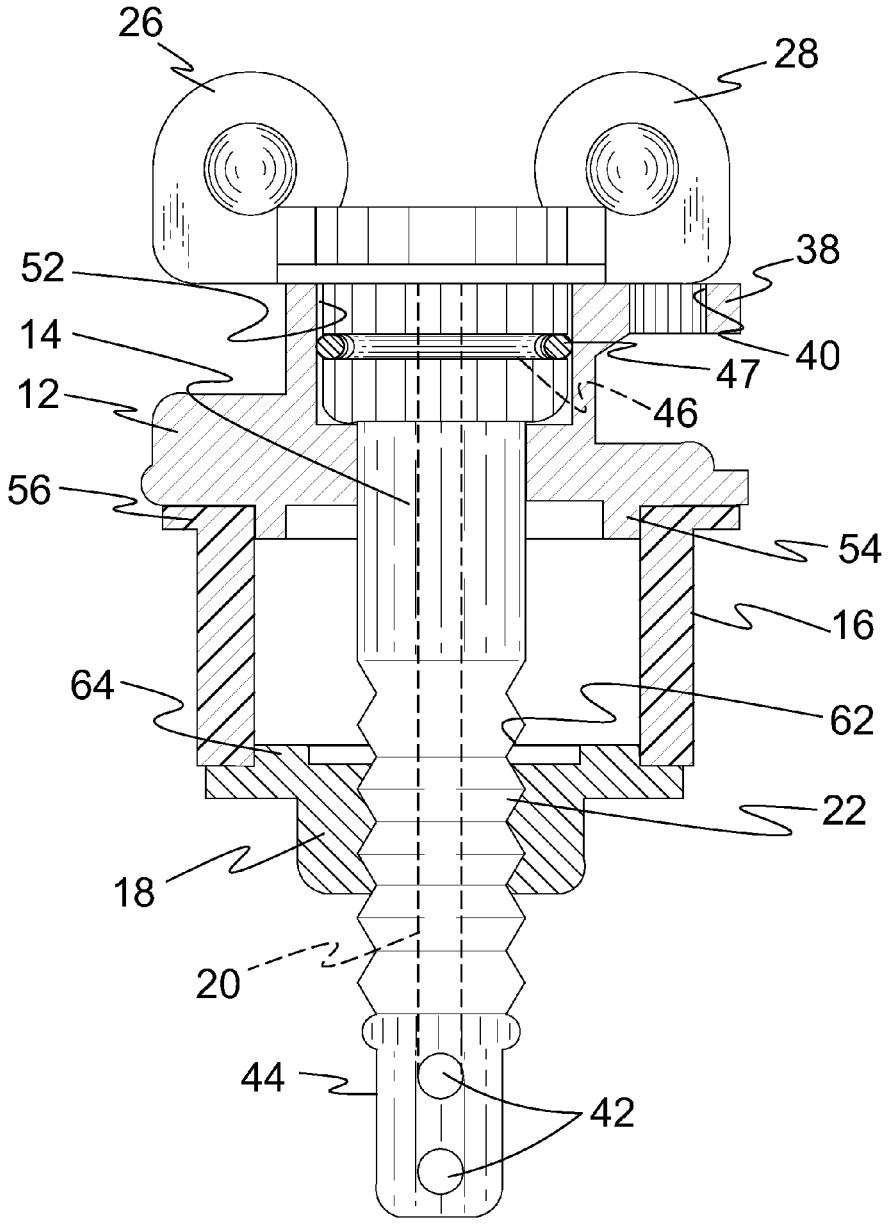
FIG. 6 is an assembled partial sectional view of the multi-function well plug of the present invention.

Referring to FIG. 6, shown is an assembled partial sectional view of the multi-function well plug 10 of the present invention. The top cap 12 and bottom cap 18, each have an annular ridge 54 and 64, respectively, spaced interiorly from the corresponding rim and sized to fit within opposing ends of the elastomeric seal ring 16 so that rotation of the shaft 14 by action of the shaft threads 22 and the bottom cap threaded bore 62 causes the bottom cap 18 to advance up the shaft 14 compressing the elastomeric seal ring 16, which will expand outwardly until frictionally engaging the interior wall of the well shaft as indicated by the directional arrows R2 and R3 in FIG. 2. The shaft 14 has an O-ring placement position 46 for an O-ring 47 sealing the shaft 14 and the top cap 12 providing a gas and water tight seal to prevent the bore contents from leaking out or the ambient environment leaking in.

Referring to FIG. 7, shown is a top perspective view of the multi-function well plug 10 of the present invention using a padlock, indicated at P. As aforementioned, the shaft 14 sits within a top cap shaft receptacle 52 with the shaft 14 having opposing side wings 26, 28 that circumferentially extend beyond the top cap platform aperture 40 so that when a padlock shackle S is inserted into the aperture 40, the shackle will extend above the platform into the rotational path of the wings 26, 28 when the shaft 14 is rotated thereby limiting rotation to no more than one half turn.

Figure 8:
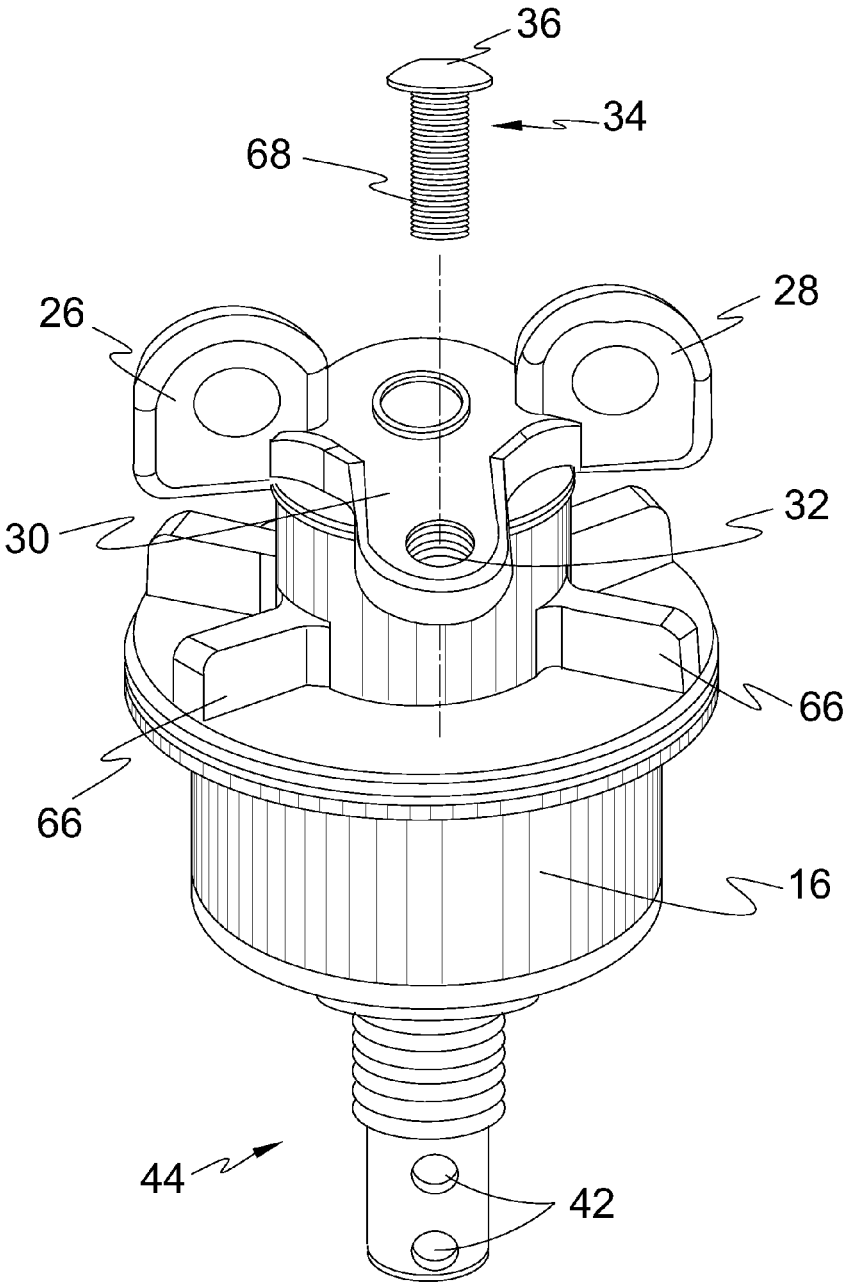
FIG. 8 is a top perspective view of the multi-function well plug of the present invention using a tamperproof locking fastener.

Referring to FIG. 8, shown is a top perspective view of the multi-function well plug 10 of the present invention using a tamperproof locking fastener 34. A tamperproof locking means is provided through the shaft 14 having an integral cantilevered platform 30 with a threaded aperture 32 forming a seat for a fastener 34 having a round head 36 having a profiled cavity that requires a similarly profiled driver to fasten and remove. Radially positioned vertical structures 66 on the top cap 12 prevent shaft rotation by virtue of the tamperproof fastener shaft 68 being stopped by interference with the radially positioned vertical structures 66 if the shaft 14 is attempted to be rotated.

Figure 9:
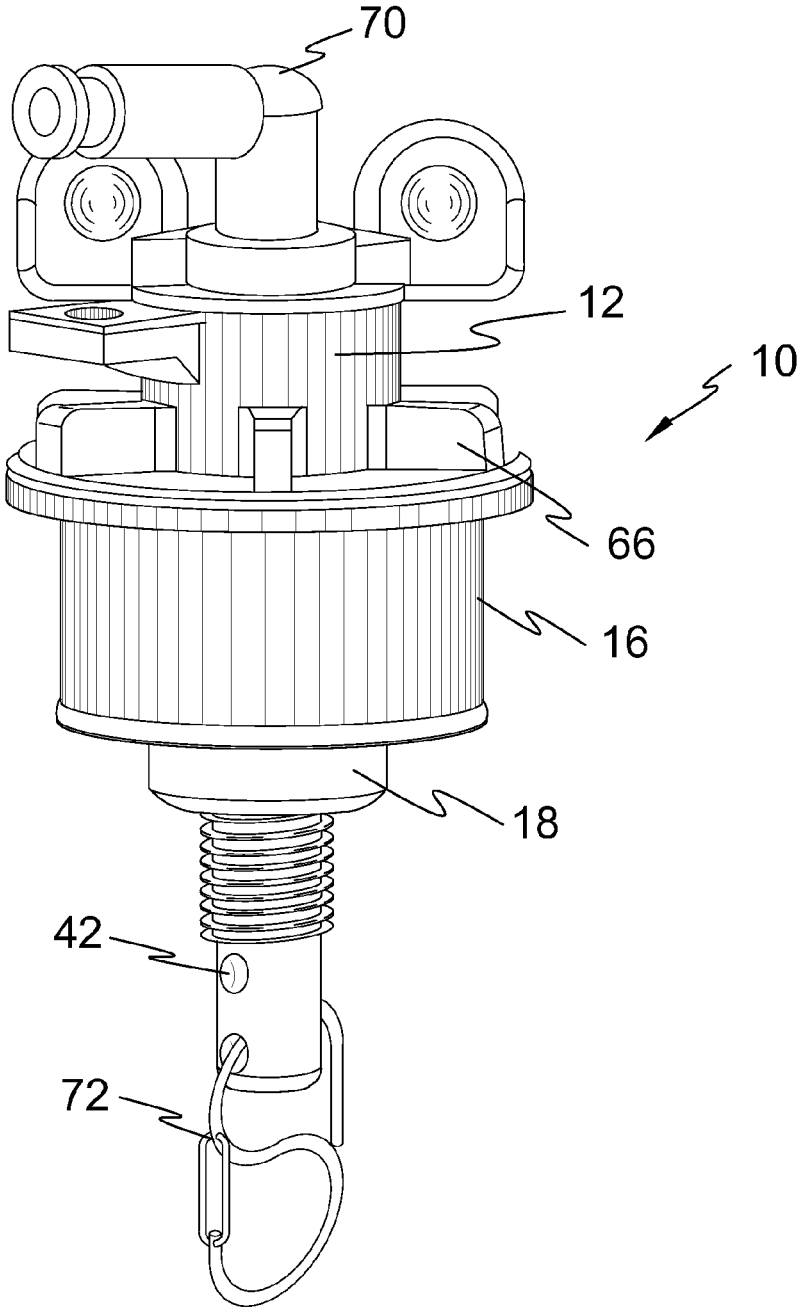
FIG. 9 is an illustrative view of the well plug of the present invention incorporating one set of the additional elements.

Referring to FIG. 9, shown is an illustrative view of the well plug 10 of the present invention incorporating additional elements. The present invention provides for a well plug having additional elements by extending the shaft cavity 20 through the top end of the shaft 14 creating a through bore whereby one or more valves, sensors or instrumentation can be attached to the top end cavity aperture as indicated at 70 whereby characteristics of the well bore can be measured or controlled through said valves, sensors or instrumentation. This could be accomplished by introducing such devices into the well bore by a clip or other attachment means as indicated at 72.

What is claimed is new and desired to be protected by Letters Patent is set forth in the appended claims:

1. A well plug comprising:

a shaft;

a top cap including a central section;

a bottom cap including a central section;

an elastomeric seal ring including a central section disposed between said bottom cap and said top cap where central sections disposed within said elastomeric seal, said top cap, and said bottom cap define a well plug throughbore and where said shaft is rotatably engageable within said well plug throughbore;

said shaft further including a top end and a base end, said shaft further including a threaded portion proximate said base end and where said bottom cap central section includes a corresponding threaded bore such that expansion of said elastomeric seal ring is accomplished by the threaded engagement between said threaded shaft portion and said bottom cap threaded bore wherein said bottom cap moves upwards towards said top cap axially in relation to said well plug throughbore compressing said elastomeric seal ring between said top cap and said bottom cap and increasing said elastomeric seal ring circumference to form a hermetic seal within a well pipe;

and at least one shaft locking means to limit rotation of said shaft after said hermetic seal is formed and said well plug is in place;

said shaft top end includes gripping means to facilitate rotation and where such gripping means comprises at least one integral cantilevered platform extending radially outwards in relation to said well plug throughbore, said integral cantilevered platform including a threaded aperture adapted to receive a first locking fastener and where said top cap also includes a plurality of radially extending vertical structures whereby a first shaft locking means comprises said first locking fastener inserted in said cantilevered platform threaded aperture such that significant rotation of the shaft is prevented by interference between said first locking fastener body and said radially extending vertical structures;

said gripping means also including a pair of opposing side wings;

and said top cap further includes a top side and a bottom side and additionally includes an integral top cap cantilevered platform extending radially in relation to said well plug throughbore, said top cap cantilevered platform being located proximate said top cap top side and where said top cap cantilevered platform also includes a top cap platform aperture adapted to receive a second locking fastener such that a second shaft locking means comprises said second locking fastener being inserted in said top cap platform aperture such that significant rotation of the shaft is prevented by interference between said second locking fastener body and said pair of opposing side wings.

2. The well plug as claimed in claim 1 wherein said first locking fastener comprises a threaded generally cylindrical body cooperating with said cantilevered platform threaded aperture and said first locking fastener further includes a rounded head having a specifically shaped cavity such that only a correspondingly shaped driver may turn it.

3. The well plug according to claim 2 wherein said driver is a torx wrench and said specifically shaped cavity corresponds thereto.

4. The well plug as claimed in claim 1 where said second locking fastener is the shackle of a padlock.

5. A well plug comprising:

a shaft, said shaft having a shaft top end and a shaft base end;

a top cap having a central section, a top cap top side, and a top cap bottom side;

a bottom cap having a central section, a bottom cap top side and a bottom cap bottom side;

an elastomeric seal ring having a central section and a circumference disposed between said bottom cap and said top cap where central sections disposed within said elastomeric seal, said top cap, and said bottom cap define a well plug throughbore and where said shaft is rotatably engageable within said well plug throughbore and further where said shaft includes a shaft bore extending axially from said shaft top end to said shaft base end;

said shaft further includes a threaded portion proximate said base end and where said bottom cap central section includes a corresponding threaded bore such that expansion of said elastomeric seal ring is accomplished by the threaded engagement between said threaded shaft portion and said bottom cap threaded bore wherein said bottom cap moves upwards towards said top cap axially in relation to said well plug throughbore compressing said elastomeric seal ring between said top cap and said bottom cap and increasing said elastomeric seal ring circumference to increase to form a hermetic seal within a well pipe;

at least one shaft locking means to limit rotation of said shaft after said hermetic seal is formed and said well plug is in place;

said shaft top end includes gripping means to facilitate rotation and where such gripping means comprises at least one integral cantilevered platform extending radially outwards in relation to said well plug throughbore, said integral cantilevered platform including a threaded aperture adapted to receive a first locking fastener and where said top cap also includes a plurality of radially extending vertical structures whereby a, first shaft locking means comprises said first locking fastener inserted in said cantilevered platform threaded aperture such that significant rotation of the shaft is prevented by interference between said first locking fastener body and said radially extending vertical structures;

said gripping means also includes a pair of opposing side wings; and said top cap further includes a top side and a bottom side and additionally includes an integral top cap cantilevered platform extending radially in relation to said well plug throughbore, said top cap cantilevered platform being located proximate said top cap top side and where said top cap cantilevered platform also includes a top cap platform aperture adapted to receive a second locking fastener such that a second shaft locking means comprises said second locking fastener being inserted in said top cap platform aperture such that significant rotation of the shaft is prevented by interference between said second locking fastener body and said pair of opposing side wings.

6. A well plug as claimed in claim 5 wherein said shaft further includes at least one shaft base transverse aperture located on said shaft base below said bottom cap bottom side and said shaft bore is in communication therewith such that fluent communication exists between said shaft top end and said shaft base aperture on opposite sides of said hermetic seal within the well pipe to allow sampling and monitoring in the interior of the pipe.

7. A well plug as claimed in claim 5 wherein said shaft further includes at least one shaft base transverse aperture located on said shaft base below said bottom cap bottom side and said shaft bore is in communication therewith such that fluent communication exists between said shaft top end and said shaft base aperture on opposite sides of said hermetic seal within the well pipe to allow sampling and monitoring in the interior of the pipe.

8. The well plug as claimed in claim 7 where said second locking fastener is the shackle of a padlock.

9. The well plug as claimed in claim 8 wherein said first locking fastener comprises a threaded generally cylindrical body cooperating with said cantilevered platform threaded aperture and said first locking fastener further includes a rounded head having a specifically shaped cavity such that only a correspondingly shaped driver may turn it.

10. The well plug according to claim 9 wherein said driver is a torx wrench and said specifically shaped cavity corresponds thereto.

11. A well plug comprising:

a shaft, said shaft having a shaft top end and a shaft base end;

a top cap having a central section, a top cap top side, and a top cap bottom side;

a bottom cap having a central section, a bottom cap top side and a bottom cap bottom side;

an elastomeric seal ring having a central section and a circumference disposed between said bottom cap and said top cap where central sections disposed within said elastomeric seal, said top cap, and said bottom cap define a well plug throughbore and where said shaft is rotatably engageable within said well plug throughbore;

an elastomeric seal ring expansion means wherein said shaft further includes a threaded portion proximate said base end and where said bottom cap central section includes a corresponding threaded bore such that expansion of said elastomeric seal ring is accomplished by the threaded engagement between said threaded shaft portion and said bottom cap threaded bore wherein said bottom cap moves upwards towards said top cap axially in relation to said well plug throughbore compressing said elastomeric seal ring between said top cap and said bottom cap and increasing said elastomeric seal ring circumference to create a hermetic seal within a well pipe;

where said shaft includes a shaft bore extending axially from said shaft top end to said shaft base end and where shaft base end further includes at least one shaft base transverse aperture located on said shaft base below said bottom cap bottom side and said shaft bore is in communication therewith such that fluent communication exists between said shaft top end and said shaft base aperture on opposite sides of said hermetic seal within the well pipe to allow sampling and monitoring in the interior of the pipe;

a first shaft locking means wherein said shaft top end includes gripping means to facilitate rotation and where such gripping means comprises a pair of opposing side wings and further includes at least one integral cantilevered platform extending radially outwards in relation to said well plug throughbore, said integral cantilevered platform including a threaded aperture adapted to receive a first locking fastener and where said top cap also includes a plurality of radially extending vertical structures whereby a first shaft locking means comprises said first locking fastener inserted in said cantilevered platform threaded aperture such that significant rotation of the shaft is prevented by interference between said first locking fastener body and said radially extending vertical structures;

a second shaft locking means wherein said top cap further includes an integral top cap cantilevered platform extending radially in relation to said well plug throughbore, said top cap cantilevered platform being located proximate said top cap top side and where said top cap cantilevered platform also includes a top cap platform aperture adapted to receive a second locking fastener such that a second shaft locking means comprises said second locking fastener being inserted in said top cap platform aperture such that significant rotation of the shaft is prevented by interference between said second locking fastener body and said pair of opposing side wings.

12. The well plug as claimed in claim 11 wherein the first shaft locking fastener comprises a threaded generally cylindrical body cooperating with said cantilevered platform threaded aperture and said first locking fastener further includes a rounded head having a specifically shaped cavity such that only a correspondingly shaped driver may turn and where shaped driver is a torx wrench and further where said second locking fastener comprises the shackle of a padlock.

* * * * *